US005433044A

United States Patent [19]

Walcher et al.

[11] Patent Number: 5,433,044

[45] Date of Patent: Jul. 18, 1995

[54] SAFETY CLAMP FOR STANDING SEAM ROOF

[75] Inventors: James G. Walcher, Willard; James R. Limbird, Attica, both of Ohio

[73] Assignee: Safety Equipment Inc., Monroeville, Ohio

[21] Appl. No.: 226,204

[22] Filed: Apr. 11, 1994

[51] Int. Cl.[6] ..... A62B 35/00; A62B 1/00; E04G 21/32

[52] U.S. Cl. ..... 52/111; 52/703; 52/DIG. 12; 52/749.12; 248/237; 182/3; 182/45

[58] Field of Search ..... 248/237, 499, 231.4, 248/316.4; 182/3, 45; 52/24, 25, 37, 111, 698, 703, 749, 750, 745.21, DIG. 12

[56] References Cited

U.S. PATENT DOCUMENTS 1,054,091 2/1913 Darnall ..... 248/237
1,659,576 2/1928 Brady et al. ..... 248/316.4 X
4,942,943 7/1990 Flaherty ..... 248/237
5,143,171 9/1992 Glynn et al. ..... 248/237 X
5,152,107 10/1992 Sheickert ..... 52/24
5,282,340 2/1994 Cline et al. ..... 52/24

*Primary Examiner*—Carl D. Friedman
*Assistant Examiner*—Robert J. Canfield
*Attorney, Agent, or Firm*—Ralph E. Jocke

[57] ABSTRACT

A safety clamp (10) attaches a safety cable (48) to standing seams (14) of a roof deck (12). The safety clamp has a housing (16) with a movable member (20) mounted therein. The housing has first tabs (18) that extend outward thereon and are engageable with first sides of the standing seams. The movable member has second tabs (22) mounted thereon that extend through cut-outs (24) in the housing. The safety clamp is attachable to the standing seams by moving a threaded member (38) to hold three standing seams in clamped relation between the tabs.

21 Claims, 4 Drawing Sheets

SAFETY CLAMP FOR STANDING SEAM ROOF

TECHNICAL FIELD

This invention relates to safety devices used in the construction industry. Particularly this invention relates to a safety clamp used to secure a safety device such as a safety line to a standing seam type roof deck.

BACKGROUND ART

In the construction of buildings workers are often required to work on roof decks. In these situations it is desirable to secure the worker to a safety line to minimize the risk of falls.

A popular type of roof deck has roof panels that fit together at standing seams. The standing seams serve to interlock the panels which holds the panels of the roof together. The standing seams extend laterally across the roof. While standing seam roofs are an excellent type of roof construction, they provide no convenient location to attach a safety line or other safety device. Further, clamping a safety line to a single seam would not be acceptable because a single seam would not have sufficient strength to hold or support a worker.

Thus, there exists a need for a safety clamp to secure a safety device such as a worker's safety line to a standing seam type roof.

DISCLOSURE OF INVENTION

It is an object of the present invention to provide a safety clamp for securing a safety device.

It is a further object of the present invention to provide a safety clamp that can be attached to a standing seam roof.

It is a further object of the present invention to provide a safety clamp that has substantial strength.

It is a further object of the present invention to provide a safety clamp that may be readily installed and removed.

It is a further object of the present invention to provide a safety clamp that may be used to secure a worker's safety line or de-reeler.

It is a further object of the present invention to provide a safety clamp that is economical.

Further objects of the present invention will be made apparent in the following Best Mode For Carrying Out Invention in the appended claims.

The foregoing objects are accomplished in the preferred embodiment of the invention by a safety clamp for attachment to a standing seam roof deck. The safety clamp has a housing which is a first member which is rectangular in cross-section and sufficiently long to traverse three standing seams of the roof deck. The housing has an interior area with three cut-outs which are each positioned to be adjacent to a standing seam. The housing also includes three first tabs which extend from the housing in a first direction. The first tabs are positioned on the housing to each engage a first side of a standing seam.

A movable member which is a second member is mounted for longitudinal movement in the interior area of the housing. The movable member is also rectangular in cross-section, and is sized to move in slideably guided supporting relation inside the housing. The movable member has three second tabs mounted thereon. The second tabs extend through the cut-outs in the housing member. The second tabs are positioned to extend from the housing in a first direction and to be on a second opposed side of a standing seam opposite of the first tabs. The second tabs are generally "Z shaped" in cross-section, and have an outboard longitudinal projection that is sized for acceptance in a recess on the second side of each standing seam.

The housing has an end cap at first longitudinal end. The movable member has a member cap at an end adjacent the first end of the housing. A threaded member extends through the end cap of the housing and threadibly engages the member cap. Turning the threaded member enables three standing seams to be clamped between the first and second tabs which secures the safety clamp to the roof.

The safety clamp of the preferred embodiment further includes a clevis on the side of the housing opposite the tabs. The clevis is attached to a worker's safety line and a de-reeler. The safety line is attached to a worker's safety harness. As a result, the worker may move about on the roof deck while tied off to the safety clamp, which minimizes the risk of falls.

BEST MODE FOR CARRYING OUT INVENTION

Figure 1:
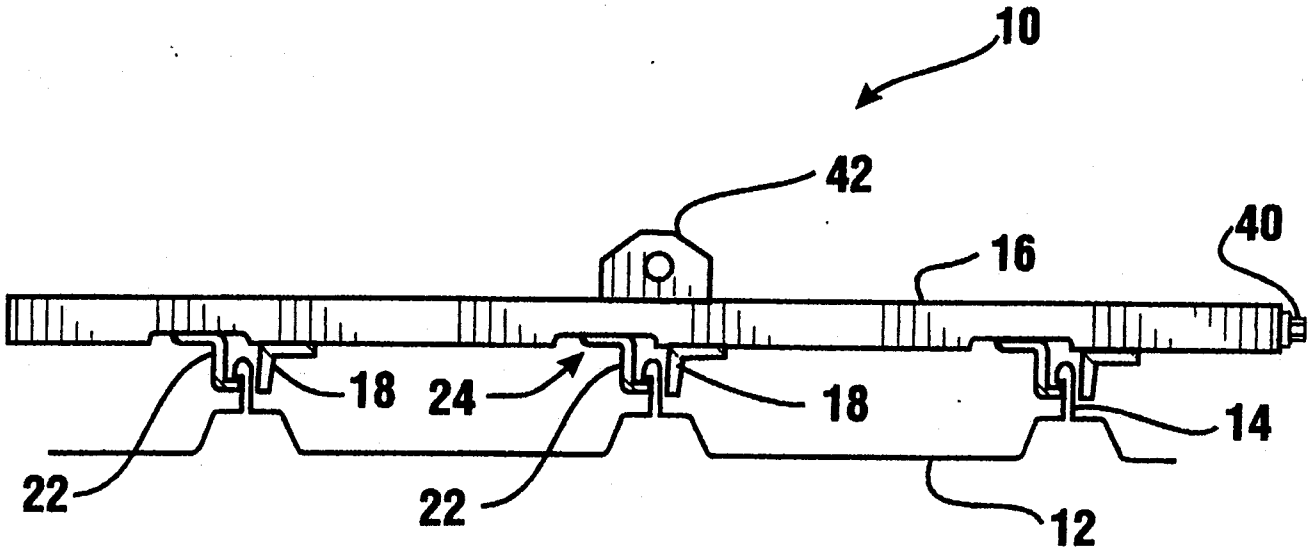
FIG. 1 is a side view of the safety clamp of the preferred embodiment of the present invention shown attached to a standing seam roof deck.

Referring now to the drawings, and particularly to FIG. 1, there is shown therein the preferred embodiment of the safety clamp of the present invention generally indicated 10. The safety clamp is shown attached to a standing seam roof deck 12 which has a plurality of longitudinally extending standing seams 14.

Safety clamp 10 has an outer housing member 16 that is generally rectangular in cross-section. The housing 16 has three first tabs 18 mounted thereon which extend from a first side of the housing. The first tabs 18 are generally "L-shaped" in cross-section, and are each engageable with a first side of a standing seam.

Figure 2:
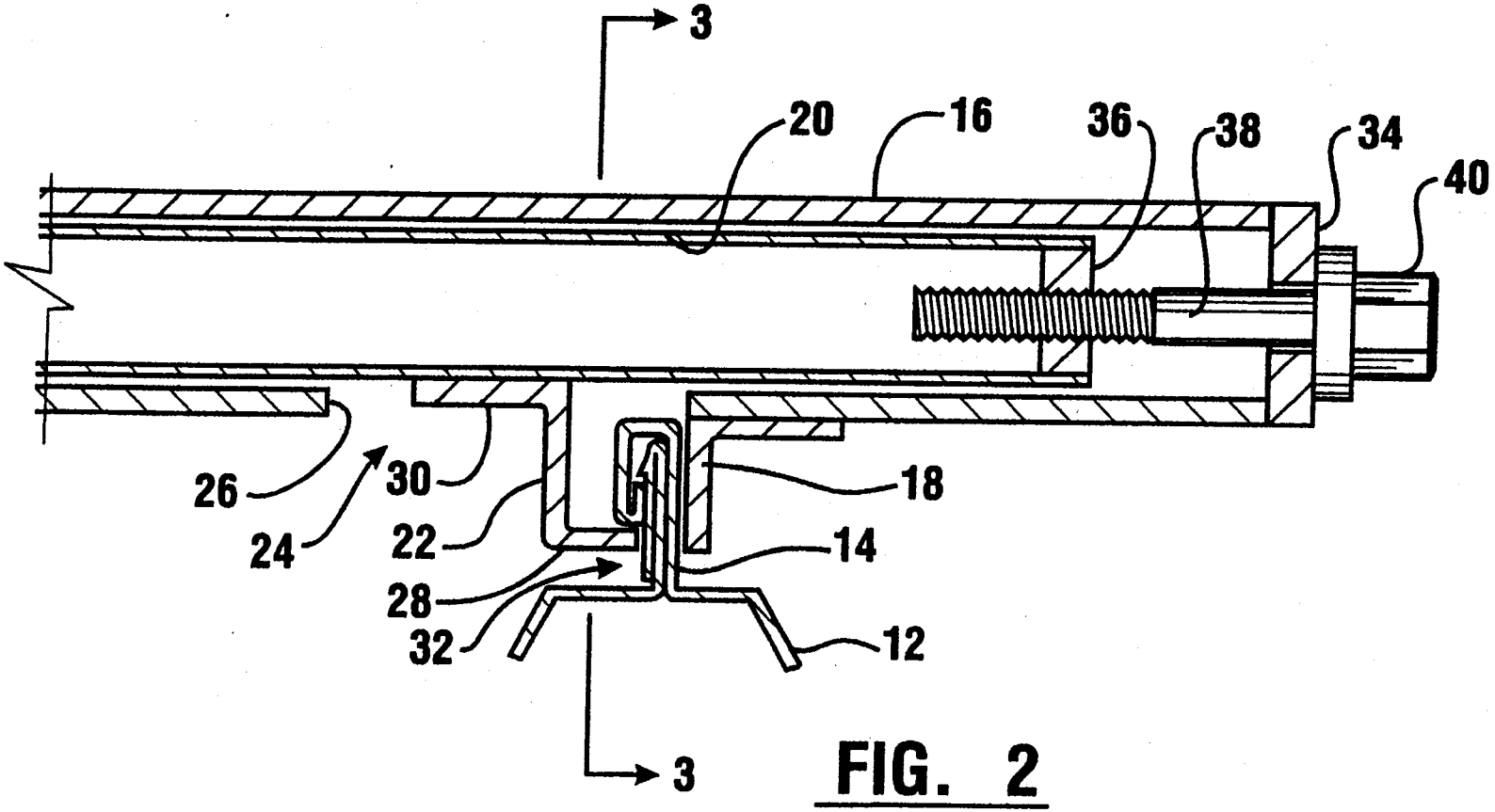
FIG. 2 is a partial cross-sectional view of the safety clamp and a standing seam.

A movable member 20 is mounted inside of housing 16 (see FIG. 2). Movable member 20 is also rectangular in cross-section and is sized to move longitudinally in slideably guided relation in the interior area of housing 16. Three second tabs 22 are mounted on movable member 20. Second tabs 22 extend through cut-outs 24 in housing 16. Cut-outs 24 are elongated longitudinally and are bounded on the sides away from the first tabs by a lip 26.

Figure 3:
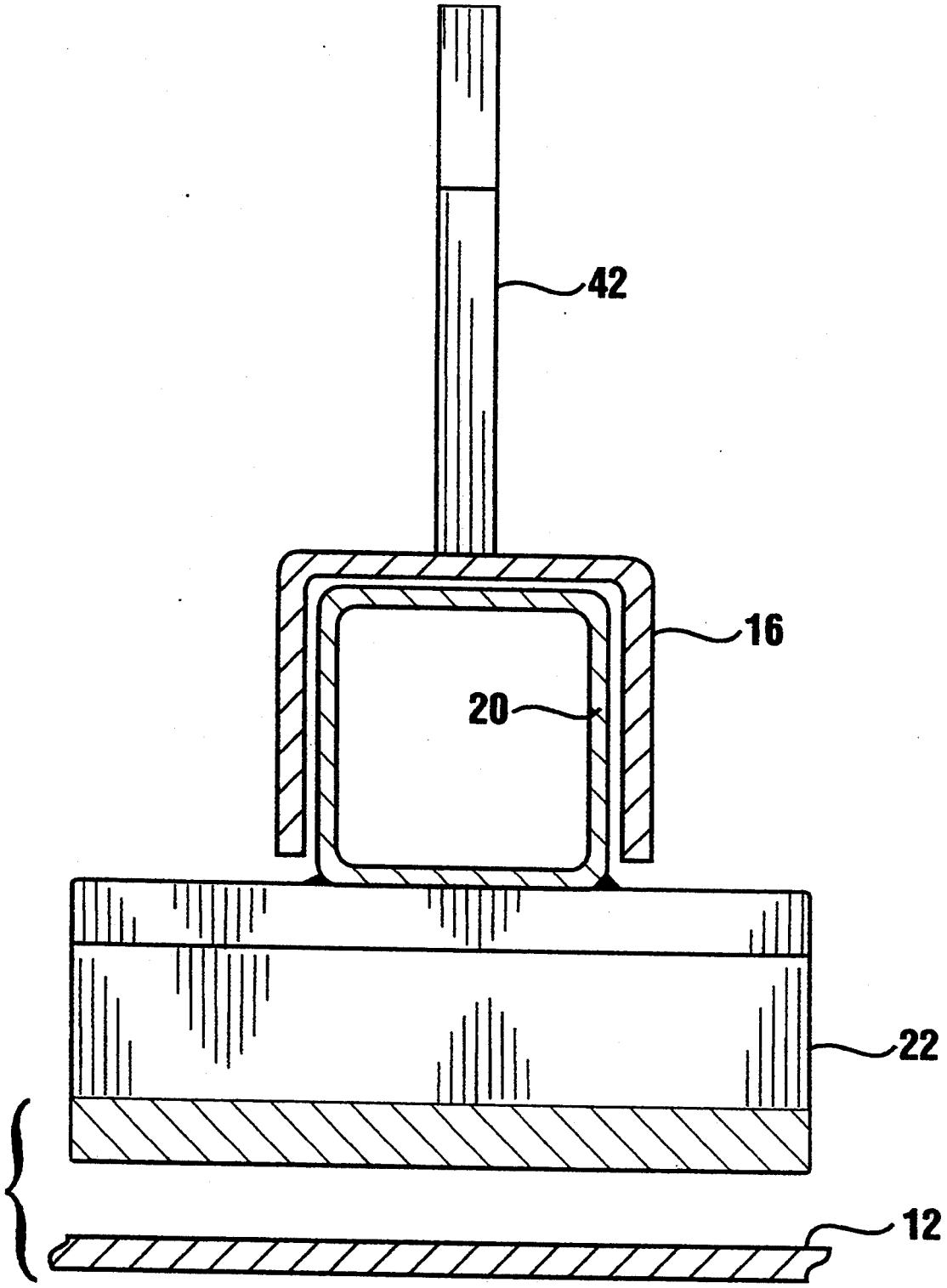
FIG. 3 is a cross-sectional view of the safety clamp and standing seam along line 3—3 in FIG. 2.

Second tabs 22 are generally "Z-shaped" in cross-section and include an outboard longitudinal projection 28 and an inboard longitudinal projection 30. In the preferred form of the invention, the standing seams 14 include recesses 32 on a second side. Outboard projection 28 is sized for acceptance in recesses 32. Further in the preferred embodiment as best shown in FIG. 3, the first tabs 18 and second tabs 22 are substantially wider than housing 16 for reasons that will be later explained.

An end cap 34 is positioned at a first longitudinal end of housing 16. A member cap 36 is positioned at an end of movable member 30 adjacent end cap 34. A threaded member 38 extends through end cap 34 and threadably engages member cap 36. Threaded member 38 has a head portion 40 at an outboard end that is readily attachable to a ratchet or other tool for rotating the threaded member. Movement of threaded member 38 in a first direction moves first tabs 18 and second tabs 22 closer together. Rotation of threaded member 38 in an opposed direction moves the tabs further apart. Separating movement of the tabs is restricted by inboard projections 30 of the second tabs 22 and lips 26 of the cut-outs which engage to prevent further separation of the tabs before threaded member 38 disengages from member cap 36.

Figure 4:
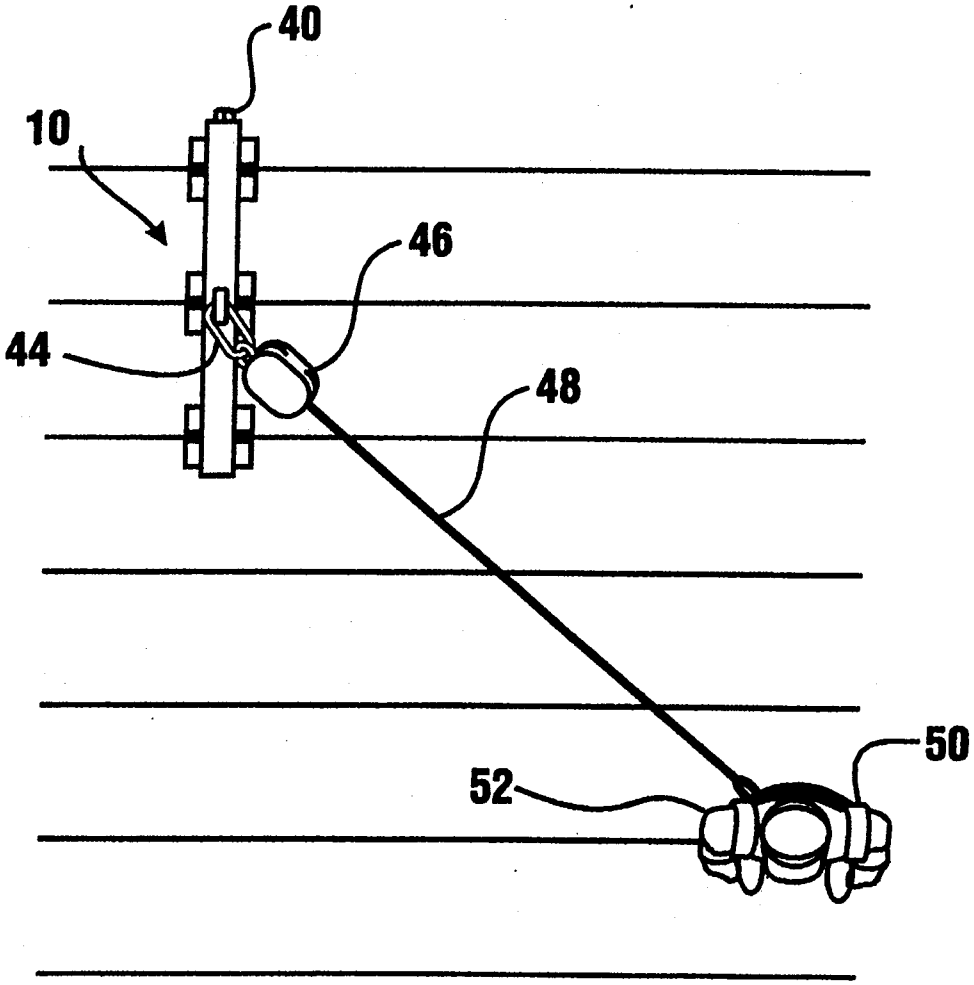
FIG. 4 is a top plan view of the safety clamp attached to a standing seam roof deck and a safety line of a worker.

Housing 16 further includes a clevis 42 on a side opposite the tabs. Clevis 42 includes an opening through which a safety device such as a ring 44 connected to a de-reeler 46 is attached (see FIG. 4). The de-reeler 46 is of the type known in the prior art which allows a safety cable 48 to move in and out of the de-reeler against a slight tension. The safety cable is attached to a safety harness 50 worn by a worker 52. The de-reeler 46 allows the safety cable to travel in and out relatively freely except in circumstances in which a sudden outward acceleration of the cable is sensed which may indicate a fall. In such circumstances, the de-reeler is designed to hold the cable 48 from further extension.

In operation, the cable clamp is first set on the roof deck 12 with the tabs separated sufficiently to accept a standing seam 14 between each pair of tabs. The clamp is positioned with the first tabs 18 on a first side of the standing seams and the second tabs 22 on an opposed side of the standing seams. Preferably the second side of the standing seams is the side having the recesses 32 thereon.

The threaded member 38 of the safety clamp is then rotated to draw the first and second tabs together so that the standing seams are in clamped relation between the tabs. As the tabs are drawn together the outboard projections 28 of the second tabs 22 nest in the recesses 32 of the standing seams. This provides a secure attachment. Because the tabs on the safety clamp are substantially wider than the housing, the amount of force required to pull the safety clamp from the standing seam once it has been properly attached thereto is very high.

While in the preferred embodiment the means for moving the movable member includes the threaded member 38, other embodiments may use other apparatus to accomplish movement thereof. All such apparatus which achieve movement of the movable member or the tabs are equivalent means which may be used successfully by those skilled in the art.

With the safety clamp securely attached to the standing seams, a de-reeler 46 or other safety device is attached to the clevis. A worker whose harness is attached to the safety cable which extends from the de-reeler is thereby securely attached to the roof deck. As a result the worker may move about the roof while minimizing the risk of falls.

If it is desired to move the position of the safety clamp, this may be readily accomplished by turning threaded member 38 to separate the first and second tabs and lifting the safety clamp upward therefrom.

Because the standing seams of the roof deck are uniformly spaced across the roof, the safety clamp of the present invention may be conveniently installed at any location across the roof. Further, because the safety clamp has a central clevis design, the safety clamp may be installed equally well with the head portion of the threaded member pointed in either direction. This enables the safety clamp to take advantage of the engagement of the second tabs in the recesses of the standing seams regardless of which direction the recesses may be oriented.

In the preferred embodiment, the safety clamp is designed for use with standing seams spaced two feet apart on the roof decking. The housing of the preferred embodiment is made of two inch square tube with a movable member made of one and a half inch square tube. Each of these is made of high-strength steel material. The tabs of the safety clamp are approximately one-quarter inch thick steel and are made about four inches wide. The safety clamp is preferably made as a weldment. The structure of the preferred embodiment is designed to serve as a safety clamp for holding a single worker's safety line. Of course, in other embodiments, other configurations and constructions may be used.

Thus the safety clamp of the present invention achieves the above-stated objectives, eliminates difficulties encountered in the use of prior devices and systems, solves problems, and attains the desirable results described herein.

In the foregoing description certain terms have been used for brevity, clarity, and understanding, however, no unnecessary limitations are to be implied therefrom because such terms are for descriptive purposes, and are intended to be broadly construed. Moreover, the descriptions and illustrations given are by way of examples and the invention is not limited to the exact detail shown or described.

Having described the features, discoveries, and principles of the invention, the manner in which it is utilized and the advantages and useful results attained; the new and useful structures, devices, elements, arrangements, parts, combinations, systems, equipment, operations, methods and relationships are set forth in the appended claims.

We claim:

1. An apparatus for securing a safety device to a roof having standing seams, comprising:

a housing member, said housing member having a plurality of first tabs extending therefrom in a first direction, each of said first tabs positionable adjacent and on a first longitudinal side of a standing seam;

a movable member mounted for longitudinal movement on said housing member, said movable member having said plurality of second tabs thereon, each said second tab extending in said first direction and positionable on an opposed side of a standing seam from said first tab; and means for moving said movable member wherein said first and second tabs are adapted to clamp standing seams therebetween.

2. The apparatus according to claim 1 wherein said housing member has an interior area, and wherein said movable member is movable in said interior area, and wherein said housing member includes said plurality of cut-outs, and wherein a second tab extends in each cut-out.

3. The apparatus according to claim 1 wherein said means for moving comprises a threaded member engaged with said housing and said movable member.

4. The apparatus according to claim 1 and wherein at least one of said tabs includes a longitudinal projection for engaging a laterally extending recess of a standing seam.

5. The apparatus according to claim 2 wherein at least one of said cut-outs is bounded by a first lip, and wherein said movable member includes at least one inboard longitudinal projection for engaging said lip, and wherein said engagement of said first lip and said inboard projection prevents further movement of said movable member separating said first and second tabs.

6. The apparatus according to claim 2 wherein said second tabs on said movable member are generally "Z-shaped" in cross-section and wherein an inboard longitudinal projection of said second tabs extends in said cut-outs, and wherein said cut-outs are bounded by a lip, and wherein said inboard projection engages said lip to prevent further separating movement of said movable member to separate said first and second tabs.

7. The apparatus according to claim 6 and wherein each of said second tabs includes an outboard longitudinal extending projection adapted for engaging a laterally extending recess of a standing seam.

8. The apparatus according to claim 7 and wherein said interior area of said housing member is bounded by a peripheral wall, and wherein said movable member is in slideably guided relation with said peripheral wall.

9. The apparatus according to claim 8 wherein said housing has an end cap at a first longitudinal end, and wherein a threaded member extends through said end cap, said threaded member engaged with said movable member and said end cap.

10. The apparatus according to claim 9 wherein said movable member has a member cap at a member end adjacent said first end of said housing member, and wherein said member cap threadibly engages said threaded member.

11. The apparatus according to claim 10 wherein said housing member includes a clevis extending therefrom in a direction opposed of said first direction.

12. The apparatus according to claim 11 wherein said housing member and said movable member are generally rectangular in cross-section, and wherein said first and second tabs are wider in a traverse direction than said housing member.

13. An apparatus for mounting a safety device to a roof having standing seams, comprising:

a housing means, having a plurality of first tab means extending therefrom in a first direction, each said first tab means engageable with a first side of a standing seam;

movable member means mounted for movement on said housing means, said movable member means including said plurality of second tab means extending therefrom in said first direction, each said second tab means engageable with an opposed side of a standing seam;

means for moving said first and second tab means in close adjacent relation wherein said first and second tab means are adapted to clamp standing seams therebetween.

14. The apparatus according to claim 13 wherein at least one of said tab means includes a longitudinally extending projection means for engaging a recess on said standing seam.

15. The apparatus according to claim 14 wherein said housing means includes cut-outs, and said second tab means extends in said cut-outs.

16. The apparatus according to claim 15 wherein each of said cut-outs include a lip, and wherein said second tab means includes a further projection means for engaging said lip to prevent further longitudinal separation of said first and second tab means.

17. The apparatus according to claim 1 and further comprising a clevis means extending from said housing means in a direction opposed of said first direction.

18. A system comprising the apparatus according to claim 13 and further comprising a safety cable and a harness means adapted to connect said safety cable to a worker.

19. The system according to claim 18 wherein said safety cable means comprises a de-reeler.

20. An apparatus for securing a safety device to a roof having standing seams, comprising:

a first member, said first member having a plurality of first tabs extending therefrom in a first direction, each of said first tabs positionable adjacent and on a first side of a standing seam;

a second member operatively connected with said first member and mounted for movement in the longitudinal direction relative thereto, said second member having said plurality of second tabs thereon, each said second tab extending in said first direction and positionable on an opposed side of said standing seam from said first tab, and means for moving said first and second tabs in close adjacent relation, wherein said first and second tabs are adapted to clamp a standing seam therebetween.

21. An apparatus for mounting a safety device to a roof having standing seams, comprising:

a housing having a plurality of first tabs engageable with a first side of a standing seam;

a movable member having a plurality of second tails engageable with an opposed side of a standing seam; and means for moving said first and second tabs to clamp said plurality of standing seams therebetween.

* * * * *